US005307126A

United States Patent [19]

Kurita

[11] Patent Number: 5,307,126

[45] Date of Patent: Apr. 26, 1994

[54] MAGNETIC BRUSH DEVELOPING APPARATUS

[75] Inventor: Takaji Kurita, Sayama, Japan

[73] Assignee: Minolta Camera Kabushiki Kaisha, Osaka, Japan

[21] Appl. No.: 967,026

[22] Filed: Oct. 27, 1992

[30] Foreign Application Priority Data

Oct. 28, 1991 [JP] Japan ..... 3-280252

[51] Int. Cl.[5] ..... G03G 15/09

[52] U.S. Cl. ..... 355/251; 118/656; 355/253

[58] Field of Search ..... 355/251, 253, 246, 261, 355/265, 259; 118/656, 657, 658, 647, 651

[56] References Cited

U.S. PATENT DOCUMENTS 4,615,606 10/1986 Nishikawa ..... 355/253 X
4,791,882 12/1988 Enoguchi et al. ..... 355/253 X
4,901,116 2/1990 Hameda et al. ..... 355/253
4,987,454 1/1991 Natsuhara et al. ..... 355/259
5,008,917 4/1991 Toyoshi et al. ..... 118/653
5,086,728 2/1992 Kinoshita ..... 355/246 X
5,140,373 8/1992 Ikegawa et al. ..... 355/253

*Primary Examiner*—Matthew S. Smith
*Attorney, Agent, or Firm*—Burns, Doane, Swecker & Mathis

[57] ABSTRACT

A developing sleeve rotary type magnetic brush developing apparatus which includes a developing sleeve having a magnet member with magnetic poles in it, an insulative layer provided on the surface of the developing sleeve, and a toner supply roll disposed for rotation in the vicinity of the developing sleeve. The toner supply roll is arranged to be formed with a thin charged toner layer on its surface, with an A.c. voltage of 0.5 to 3 kV, and 50 Hz to 3 kHz being impressed between the toner supply roll and the developing sleeve.

10 Claims, 2 Drawing Sheets

MAGNETIC BRUSH DEVELOPING APPARATUS

BACKGROUND OF THE INVENTION

1. Field of the Invention

The present invention generally relates to a developing apparatus for use in electrophotography, and more particularly, to a developing sleeve rotary type magnetic brush developing apparatus which includes a developing sleeve having an internal magnet member with magnetic poles.

2. Description of Related Art

Conventionally, in the electrophotographic developing method, there have been proposed many processes, among which an important method most widely applied to practical applications is a two or dual-component developing method. In this dual-component developing method, the magnetic brush process which transports toner mixed in a magnetic carrier by a magnetic field for developing has many superior points such as high image quality, low cost and stability in characteristics, and wide range of selection of materials, etc., and is employed as a standard practice for visualizing electrostatic latent images.

For the magnetic carrier, magnetic particles or powder having particle diameters slightly larger than toner such as iron particles, triiron tetroxide (magnetite), ferrite and the like are employed. Particles of ferrite, magnetite, etc. are made into powder of the required particle size by grinding after kneading and solidification or by sintering after granulation with a water base binder. Most of the ordinary carrier is in the form of spherical shape about 30 to 100 μm or indefinite particle shape.

When mixed into carrier, toner is electrically charged through contact with carrier face, and forms a uniform mixture by being attracted to carrier, and is restricted by the magnetic field of the magnet member of the developing roll so as to be transported to an electrostatic latent image holding member such as a photoreceptor or the like. The developing is generally effected at the portion where the magnetic field of the developing roll is perpendicular to the surface of the electrostatic latent image holding member. The magnetic carrier particles are formed in a line contacting each other along the direction of the magnetic field, and forms brush bristles (magnetic brush) at the magnetic field vertical portion on the internal magnetic poles of the magnet member in the developing roll. At such brush bristle portion, gaps are formed in a direction perpendicular to the face, and through the gaps, toner are moved by the actin of the electric field to effect the developing.

Although the dual-component developing method described above has various advantages referred to earlier as compared with a mono-component developing method and the like, there is a problem in that it is low in the developing efficiency, and difficult to maintain the toner concentration in the carrier to be constant and uniform.

When the toner concentration in the developing material is lowered, the toner charge amount is increased, with reduction of the image density. Conversely, upon increase of the toner concentration in the developing material, the toner charge amount is reduced, and fogging or soiling tends to appear, with an increase of toner scattering. Moreover, since toner is not naturally dispersed as in a liquid, non-uniformity in density is apt to appear, with a consequent deterioration in the image quality. Accordingly, constant and uniform control of the toner concentration is very important.

Generally, since the optimum amount of addition of toner to the carrier is less than 10%, the toner concentration fluctuates even by a slight mount of toner consumption in the developing, and the image characteristic tends to vary to a large extent. Furthermore, for the supply of toner, mixing can not be achieved merely by addition, but a sufficient stirring is required. If the stirring is not enough, toner aggregation remains without being crushed, resulting in fogging, soiling or the like which may give rise to image noises.

The reason why the two-component developing apparatus tends to be heavy in weight and large in size, with a high cost, is considered to be attributable to the fact that a large space is required for the toner replenishment and mixing and the toner concentration is difficult to be controlled.

In order to solve the problems as described above, there has conventionally been proposed, for example, in Japanese Patent Laid-Open Publication Tokkaisho No. 59-111664 or Tokkaisho No. 61-80280, a toner automatic replenishing system in which magnetic carrier is caused to be attracted onto a developing sleeve including a magnet member therein so as to adjust the developing material by supplying charged toner to said carrier from a toner supply roll. By the above known replenishing system, although a stirring section may be dispensed with for compact size of the developing apparatus, it is still difficult to completely solve the problem for stability in the charging and supply of the developing material, and the problem related to the image quality and fogging, etc.

One of the reasons for such disadvantages is due to the fact that the toner concentration automatic control effect has largely depended not on a perfect electrostatic process, but, on a toner exchange balance process between the developing material supply roll and the developing roll. Therefore, a sufficient automatic concentration adjusting effect can not be achieved unless the toner exchange amount is considerably increased. However, if the above exchange amount is large, the toner with a small charge amount on the supply roll is to be supplied and collected by a large amount at all times, thus generating fogging. Moreover, owing to the necessity to control the charged toner layer on the supply roll to constant thickness by a restriction blade, thickened toner layer is scraped off, and by the erasing function with electrical discharging which takes place this time, the toner particles are subjected to large non-uniform charge, thereby to form the aggregate, which also results in the image deterioration. Additionally, there are also such problems as fusion of toner onto the supply roll and variation of image characteristics, etc. due to particle diameter selecting effect.

SUMMARY OF THE DISCLOSURE

Accordingly, an essential object of the present invention is to provide a magnetic brush developing apparatus in which, in a developing sleeve rotary type magnetic brush developing apparatus including the developing sleeve having an internal magnet member with magnetic poles therein, toner concentration and toner charge are more stabilized than in the conventional arrangements for reducing such problems as faulty images due to fogging and toner scattering, etc.

Another object of the present invention is to provide a magnetic brush developing apparatus of the above described type which is simple in construction and stable in functioning at high reliability.

As a result of various studies made into the matter, the present inventor has found that the toner concentration and stability in the toner charging aimed at in the above objects may be achieved to solve the problems such as fogging, toner scattering, etc., if favorably charged toner is supplied only to the portion in the magnetic brush on the developing sleeve where toner has been consumed.

More specifically, in the developing sleeve rotary type magnetic brush developing apparatus having the developing sleeve with internal magnetic poles, charged toner moves from the developing material layer on the developing sleeve onto the electrostatic latent image holding member such as a photoreceptor surface or the like according to the density of images during development, and opposite charge equal to the charge amount of the lost toner is produced on the developing material layer on the developing sleeve, which is generally referred to as counter-charge. If toner is supplied according to such counter-charge, it becomes possible to selectively replenish the toner, and the present inventor has directed attention to this point.

At the early stage of the study, a sufficiently favorable result could not necessarily be obtained, because, due to the fact that the counter-charge is not fully preserved in the conventional developing system, the counter-charge amount has been reduced at the portion where the toner was consumed, and therefore, toner with a small charge amount must be supplied in order to fully replenish the same amount of toner as the lost toner. However, if the toner with a small charge amount is replenished, rising of charge is insufficient by one rotation of the developing sleeve, and such a portion appears as fogging. For preventing such a defect, rising of toner charge is required by stirring the developing material, but the developing apparatus becomes undesirably bulky, if a sufficiently large stirring portion is provided, and thus, the initial object of the study is lost. Meanwhile, in the conventional developing systems, it is essential that the counter-charge completely disappears during one rotation of the developing sleeve, and if such disappearance of the counter-charge is insufficient, either ghost images are formed or the developing itself is obstructed. This counter charge will escape through restricting members and wall surfaces of the developing apparatus, with most of said counter-charge being dispersed through the surface of the developing sleeve for disappearance. Accordingly, in a practical application, it was indispensable for the surface of the developing sleeve to be electrically conductive to permit the counter-charge to escape.

By making the reverse use of the above point, the present inventor intends to perfectly neutralize the reserved counter-charge by the charged toner for disappearance, and this arrangement simultaneously means that replenishment of the toner may be automatically effected, thus making it possible to realize a favorable automatic toner concentration adjusting function. The present invention has been completed by the process of studies as described above.

In accomplishing these and other objects, according to one preferred embodiment of the present invention, there is provided a developing sleeve rotary type magnetic brush developing apparatus which includes a developing sleeve having a magnet member with magnetic poles therein, an insulative layer provided on the surface of said developing sleeve, and a toner supply roll disposed in the vicinity of said developing sleeve. The toner supply roll is arranged to be formed with a thin charged toner layer on it surface, with an A.C. voltage of 0.5 to 3 kV, and 50 Hz to 3 kHz being impressed between said toner supply roll and said developing sleeve.

As one preferable example of the above developing apparatus, the toner supply roll is disposed, with one part of its surface contacting toner within powder toner tank, and remaining one part thereof confronting said developing sleeve, and an electrode is provided within said powder toner tank so as to face the surface of said toner supply roll. The electrode is directed towards said toner supply roll in a plane parallel to a shaft of said toner supply roll, with a closest distance between said electrode and said toner supply roll being set to be 100 to 500 μm, and an A.C. voltage of 0.5 to 3 kV and 50 Hz to 3 kHz being impressed between said electrode and said toner supply roll.

By the arrangement according to the present invention as described above, the developing material composed of toner and carrier is supported on the surface of the developing sleeve in the form of a magnetic brush by the action of the magnet member within the developing sleeve, and is transported through rotation of said developing sleeve, to the developing zone, where the toner is used for visualizing the electrostatic latent image formed on the surface of the electrostatic latent image holding member. In the carrier of the magnetic brush in which the toner has been consumed, counter-charge remains with respect to the toner charge, since the insulative layer is formed on the surface of the developing sleeve. When the magnetic brush in which the toner has been consumed confronts the toner supply roll as the developing sleeve rotates, charged toner is supplied thereat to the magnetic brush from the toner supply roll so as to adhere to said magnetic brush, and is transported to the developing region. However, the charged toner does not adhere to the magnetic brush without consumption of the toner.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENT

Figure 1:
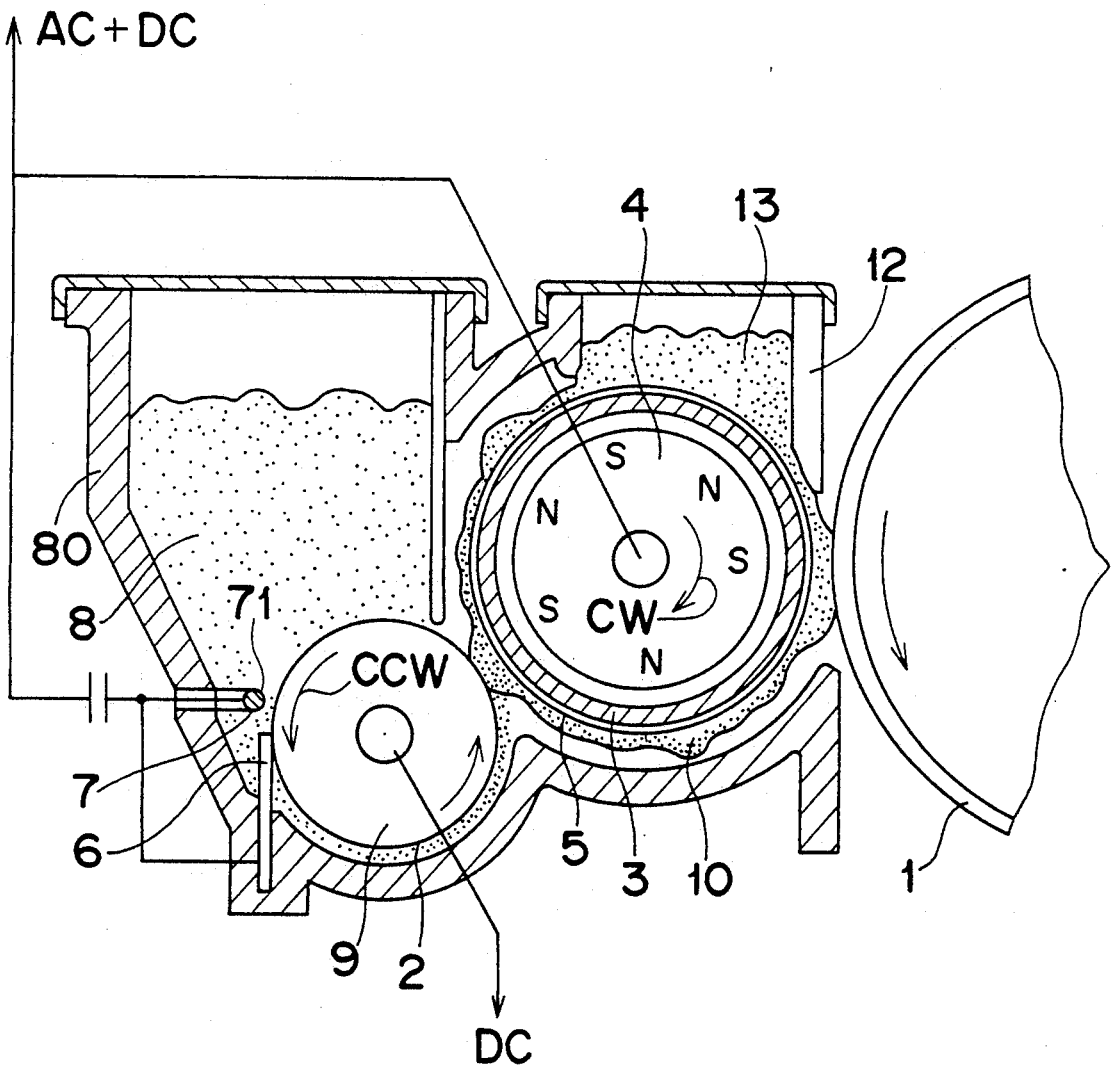
FIG. 1 is a schematic side sectional view of a developing apparatus according to one preferred embodiment of the present invention.

Before the description of the present invention proceeds, it is to be noted that like parts are designated by like reference numerals throughout the accompanying drawings.

Referring now to the drawings, there is shown in FIG. 1, a magnetic brush developing apparatus according to one preferred embodiment of the present invention which generally includes a non-magnetic developing sleeve 3 disposed adjacent to a photoreceptor drum 1 of an image forming apparatus, an insulative thin layer 5 formed on an outer peripheral surface of the developing sleeve 3, a magnet member 4 fixedly provided within the developing sleeve 3, and a toner supply roll 9 rotatably disposed below a powder toner tank 80 and in the vicinity of the developing sleeve 3.

The developing sleeve 3 is driven for rotation in a direction indicated by an arrow CW by a driving means (not shown), and is impressed with a developing bias in which A.C. current is superposed on D.C. current. To the peripheral surface of the developing sleeve 3, a restricting member 12 is directed towards an upstream side of the developing region, and the toner supply roll 9 is also directed to a still more upstream side as illustrated. The toner supply roll 9 is arranged to be driven for rotation in a direction indicated by an arrow CCW.

The toner supply roll 9 is held in contact, at one part of its peripheral surface, with toner 8 in the powder toner tank 80, and confronts the developing sleeve 3 at the other part thereof.

Meanwhile, an electrode 7 embedded in the toner 8 within the powder toner tank 80 is directed to the toner supply roll 9 in a plane 71 parallel to a rotary shaft of said roll 9, with said electrode 7 being arranged to be applied with an alternating voltage. Moreover, a toner restricting member 6 is directed to the toner supply roll 9 in a position slightly at a downstream side of the electrode 7 in the rotating direction thereof.

In the developing apparatus according to the present invention as described above, the developing material 10 composed of toner and carrier is supported on the surface of the developing sleeve 3 in the form of a magnetic brush by the action of the magnet member 4 within the developing sleeve 3, and is transported to the developing zone as the developing sleeve 3 rotates, while being restricted for its transported amount by the restricting member 12 in the course so as to be used for visualizing the electrostatic latent image on the photoreceptor drum 1 at said developing zone. At an upstream side of the restricting member 12, a pool 13 of the developing material is formed. In the carrier of the magnetic brush in which the toner has been consumed, counter-charge with respect to the toner charge remains owing to the fact that the insulative layer 5 is formed on the surface of the developing sleeve 3. When the above magnetic brush in which the toner has been consumed faces the toner supply roll 9 as the developing sleeve rotates, the charged toner 2 is supplied from the toner supply roll 9, and adheres to the magnetic brush so as to be transported to the developing zone. However, the charged toner 2 does not adhere to the magnetic brush in which the toner has not been consumed.

One of the features of the above developing apparatus according to the present invention is that the insulative layer 5 is provided on the peripheral surface of the developing sleeve 3. Since the presence of such an insulative layer obstructs dissipation of the counter-charge, it is possible to neutralize the counter-charge by pouring the charged toner 2 from the supply roll 9 for collective elimination thereof.

Figure 2:
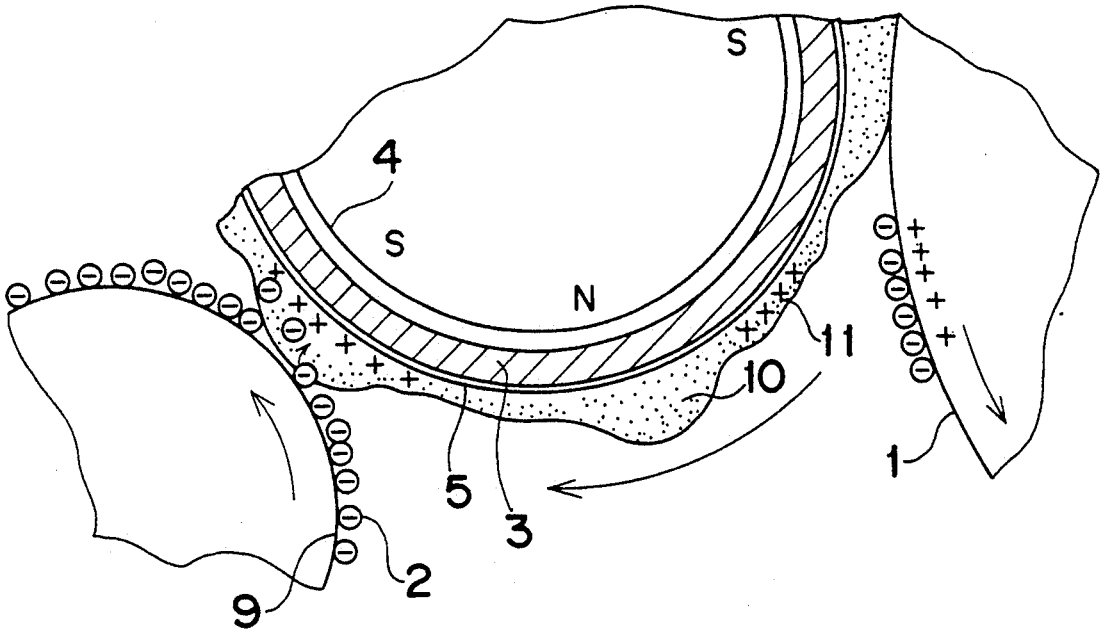
FIG. 2 is a fragmentary side sectional diagram for explaining principle of operation of the apparatus of FIG. 1.

FIG. 2 shows the principle of operation of the developing apparatus of FIG. 1.

When the developing material 10 composed of toner and carrier contacts the electrostatic latent image on the photoreceptor drum 1 and discharges the charged toner to start the developing, counter-charge 11 equal in size and opposite in the sign is produced in the developing material. In the conventional arrangements, such counter-charge 11 is to be subjected to stirring effect by the mutual action of the transport action of the developing material carrier by the developing sleeve 3 and the magnetic field of the magnet member 4, and disappears mainly through the surface of the developing sleeve 3. According to the present invention, however, since there is provided the insulative layer 5 on the surface of the developing sleeve 3, shifting of charge from the carrier to the developing sleeve 3 does not take place, and the charge moves up to the brush bristle portion at a position confronting the supply roll 9 in the same state as it is. In the above case, the negatively charged toner 2 on the supply roll 9 is vibrating by the A.C. (alternating) electric field, and enters the developing material through gaps at the brush bristle portion so as to neutralize the counter-charge. At the portion where the counter-charge is not present, even if the charged toner enters inside, it is pushed back to the original position by an electrostatic field by the charge of the toner itself, and consequently, does not stay inside.

In the manner as described so far, the toner 2 is to be supplied selectively, but some conditions are required for the toner concentration to be actually maintained constant. A first condition is such that the electric field within the developing material layer is fully erased in the gap between the toner supply roll 9 and the developing sleeve 3. Such erasing is effected by the alternating electric field to be impressed across the gap and the charged toner vibrating in such electric field. Values larger than a certain degree are required (above 500 V) for the alternating electric field, and it is necessary that the toner supply roll 9 confronts the magnet pole position of the magnet member 4, and satisfies the condition approximately equal to that in the developing zone.

A second condition is such that the toner to be replenished has a uniform charge on the supply roll 9, and the charge amount thereof is approximately equal to the toner charge amount in the developing material. The formation of such uniformly charged toner layer is effected by the action of the A.C. impression electrode 7 and the restricting blade 6. According to the present invention, the electrode 7 is provided in the toner tank 80, in a position before entering the restricting blade 6 with respect to the surface of the supply roll 9, with an alternating voltage being applied to said electrode, it becomes possible to vibrate the toner particles within the toner tank 80 for uniform charging so as to form the charged toner layer without imparting a strong stress.

Most of the toner 8 in the toner tank 80 is not charged, and non-uniform in the density, with a large irregularity as observed microscopically. When the toner supply roll 9 is rotated in the toner as described above, the toner at portions having a high density and strongly contacting the surface of the supply roll 9 is favorably charged and attracted onto the surface of the supply roll 9 so as to adhere in a thick layer, while at portions with a low density to form a hollow portion, the toner hardly adheres to the surface of the supply roll 9. Therefore, although uniform adhesion of toner can not be achieved only by merely rotating the supply roll 9 within the toner 8, if the electrode is provided close to the surface of the rotating supply roll 9, with application of an alternating voltage under a proper condition, the peripheral surface of the supply roll 9 is generally evenly covered by the charged toner.

The reason for the above function is considered to be attributable to the fact that the charged toner particles are moved through dispersion by the vibration caused by the alternating electric field, towards the portion with a low density and the hollow portion. Such charged toner particles break down aggregation of other uncharged toner particles for movement by the vibration arising from the electric field. As the moved particles vibrate on the surface of the supply roll 9 for repeated contacts, charging of the toner particles is accelerated, and thus, a toner layer having a highly uniform charging not available by the ordinary dynamic passing friction of the blade gap may be formed. Moreover, such newly charged toner particles move other particles in a manner as in a chain reaction, and furthermore, the charged particles are rapidly dispersed by a repelling action of the charge in the same polarity. This is considered to be a cause of the formation of the uniform charged toner layer.

Since the layer of the charged toner particles thus formed is strongly attracted onto the surface of the supply roll 9, the charged toner particles readily pass through the gap of the restricting blade, but the uncharged toner particles do not pass therethrough. For the electrode 7, a metallic wire of stainless steel, steel, or the like stretched in a direction parallel to the surface of the supply roll 9 or an electrically conductive rod may be employed. The electrode 7 obstructs passing of toner if it is too large, and is subjected to vibration or breakage if it is too small in its size or diameter. Generally, it should be in the range of about 100 μm to 5 mm, and a plurality of such electrode may be employed. A distance of the electrode 7 form the surface of the roll 9 should be from 100 μm to 500 μm at the closest position. If the distance is smaller than this, electrical discharge tends to take place, while if it is larger, the electric field becomes smaller for reduction of effect.

The frequency of the alternating voltage is ineffective if it is too low, while the vibration amplitude becomes small for lower efficiency if it is too high. Therefore, the frequency thereof should preferably be in the range of 50 Hz to 3 kHz. The electric field by the alternating voltage has no effect under 500 V/mm, while the electrical discharge is liable to take place above 10,000 V/mm, although different according to the size of the gap. In general, alternating voltage in the range of about 500 V to 3 kV may provide a favorable effect.

As described so far, the uniform toner layer having a high electrical charge generally equal to that of the toner in the developing material can be formed on the surface of the toner supply roll 9. By the charge of the above toner layer, a necessary amount of toner may be replenished simultaneously with the erasing of the counter-charge, and the charge of the toner in the developing material on the sleeve 3 is to be maintained uniform. It is to be noted here that the toner of faulty charge and excessive toner are removed by the blade 6, and thus, the thickness of toner on the supply roll 9 maybe maintained uniform.

Although detailed description about the blade 6 is abbreviated here for brevity, the thickness of the toner layer is determined by a curvature at a forward edge thereof and a pressure applied thereby.

As will be understood by the principle of the present invention, a wide variety of materials may be employed for the insulative layer 5 on the surface of the developing sleeve 3. For example, the alumite layer, organic high polymer compounds, such as acrylic resin, polyester, epoxy resin, etc., painting by paints, inorganic semiconductor evaporation layer, and original semi-conductor coating layer, etc. may be employed, and the range of insulation characteristics may be wide from $10^8$ to $10^{14}$ Ωcm or thereabout in the volume resistance. However, there are cases where the developing efficiency is affected if the thickness exceeds 30 μm.

As is clear from the foregoing description, in the developing sleeve rotary type magnetic brush developing apparatus having the developing sleeve with internal magnetic poles according to the present invention, since the stably charged toner is accurately supplied automatically to the magnetic brush on the developing sleeve in which the toner is consumed by the developing in the necessary amount so as to maintain the toner density constant, faulty images by fogging and the like or problem such as scattering of toner are prevented by that extent, while owing to the fact that the developing material stirring portion and toner concentration adjusting mechanism, etc. can be dispensed with, the developing apparatus simple in construction and superior in reliability and durability can be advantageously presented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A developing sleeve rotary type magnetic brush developing apparatus which comprises a developing sleeve having a magnet member with magnetic poles therein, an insulative layer provided on the surface of said developing sleeve for obstructing dissipation of a countercharge, and a toner supply roll disposed for rotation in the vicinity of said developing sleeve, said toner supply roll being arranged to be formed with a thin charged toner layer on its surface, with an A.C. voltage of 0.5 to 3 kV, and 50 Hz to 3 KHz being impressed between said toner supply roll and said developing sleeve.

2. A magnetic brush developing apparatus as claimed in claim 1, wherein said toner supply roll is disposed, with one part of its surface contacting toner within a powder toner tank, and remaining one part thereof confronting said developing sleeve, and an electrode is provided within said powder toner tank so as to face the surface of said toner supply roll, said electrode being directed towards said toner supply roll in a plane parallel to a shaft of said toner supply roll, with a closest distance between said electrode and said toner supply roll being set to be 100 to 500 μm, and an A.C. voltage of 0.5 to 3 kV and 50 Hz to 3 kHz being impressed between said electrode and said toner supply roll.

3. A magnetic brush developing apparatus as claimed in claim 1, wherein a thickness of said insulative layer provided on the surface of said developing sleeve is less than 30 μm.

4. A magnetic brush developing apparatus as claimed in claim 1, wherein said magnetic poles are provided within said developing sleeve disposed at the position confronting close to said toner supply roll.

5. A magnetic brush developing apparatus as claimed in claim 1, wherein an opposite charge equal to a charge amount of toner that moves from the developing sleeve to an electrostatic latent image holding member is produced on the insulative layer.

6. A developing sleeve rotary type magnetic brush developing apparatus comprising:

a developing sleeve carrying a two-component developer thereon, and having a magnet member with magnetic poles therein and an insulative layer provided on its surface to obstruct dissipation of a countercharge;

a toner supply roll disposed for rotation in the vicinity of said developing sleeve, said toner supply roll being arranged to be formed with a thin charged toner layer on its surface; and an A.C. voltage of 0.5 kV to 3 kV and 50 Hz to 3 KHz being impressed between said toner supply roll and said developing sleeve.

7. A magnetic brush developing apparatus as claimed in claim 6, wherein said toner supply roll is disposed, with one part of its surface contacting toner within a powder toner tank, and remaining one part thereof confronting said developing sleeve, and an electrode is provided within said powder toner tank so as to face the surface of said toner supply roll, said electrode being directed towards said toner supply roll in a plane parallel to a shaft of said toner supply roll, with a closest distance between said electrode and said toner supply roll being set to be 110 to 500 μm, and an A.C. voltage of 0.5 kV to 3 kV and 50 Hz to 3 kHz being impressed between said electrode and said toner supply roll.

8. A magnetic brush developing apparatus as claimed in claim 6, wherein a thickness of said insulative layer provided on the surface of said developing sleeve is less than 30 μm.

9. A magnetic brush developing apparatus as claimed in claim 6, wherein said magnetic poles are provided within said developing sleeve disposed at the position confronting close to said toner supply roll.

10. A magnetic brush developing apparatus as claimed in claim 6, wherein an opposite charge equal to a charge amount of toner that moves from the developing sleeve to an electrostatic latent image holding member is produced on the insulative layer.

* * * * *